US012663197B2

(12) United States Patent
Pellegrini et al.

(10) Patent No.: US 12,663,197 B2
(45) Date of Patent: Jun. 23, 2026

(54) REFRIGERATOR WITH A VARIABLE SPEED COMPRESSOR AND A METHOD FOR CONTROLLING THE COMPRESSOR SPEED

(71) Applicant: ELECTROLUX APPLIANCES AKTIEBOLAG, Stockholm (SE)

(72) Inventors: Tommaso Pellegrini, Porcia (IT); Mario Vargas, Stockholm (SE); Augusto Buosi, Porcia (IT)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 206 days.

(21) Appl. No.: 18/279,094

(22) PCT Filed: Mar. 26, 2021

(86) PCT No.: PCT/EP2021/057939
§ 371 (c)(1),
(2) Date: Aug. 28, 2023

(87) PCT Pub. No.: WO2022/199845
PCT Pub. Date: Sep. 29, 2022

(65) Prior Publication Data
US 2024/0142158 A1 May 2, 2024

(51) Int. Cl.
*F25D 17/06* (2006.01)
*F25B 49/02* (2006.01)

(52) U.S. Cl.
CPC ..... *F25D 17/065* (2013.01); *F25B 49/022* (2013.01); *F25B 2600/025* (2013.01); *F25D 2700/121* (2013.01)

(58) Field of Classification Search
CPC ..... F25D 17/065; F25D 2700/121; F25B 2600/25; F25B 49/022
See application file for complete search history.

(56) References Cited

U.S. PATENT DOCUMENTS 6,438,978 B1 * 8/2002 Bessler ..... F25B 41/347 62/223
2003/0182957 A1 10/2003 Hu
(Continued)

FOREIGN PATENT DOCUMENTS

EP 1176346 1/2002
EP 2717000 4/2014
(Continued)

OTHER PUBLICATIONS

International Search Report for PCT/EP2021/057939, dated Jan. 5, 2022, 3 pages.
(Continued)

*Primary Examiner* — Elizabeth J Martin
(74) *Attorney, Agent, or Firm* — Chrisman Gallo Tochtrop LLC

(57) ABSTRACT

Refrigerator (200, 210) comprising a compartment (13*a*) for storing foodstuff; a cooling system (200, 210) comprising an evaporator (12*a*), a condenser (14) and a variable speed compressor (10), the cooling system (200, 210) being adapted to go through a refrigeration cycle at certain intervals. A control system (11) is configured to control the variable speed compressor (10) during the refrigeration cycle, the control system (11) being based on a minimum speed (36) and a required speed (22), whereby the control system (11) is configured to set the compressor speed (35) to the highest speed of both the minimum speed (36) and the required speed (22). Such control system (11) provides an improved performance of the cooling system (200, 210), maintaining a balance of different temperatures inside the refrigerator (100, 110).

16 Claims, 11 Drawing Sheets

(56) References Cited

U.S. PATENT DOCUMENTS

| | | | | |
|---|---|---|---|---|
| 2007/0012055 | A1* | 1/2007 | Schenk | F25D 29/00 62/208 |
| 2019/0383539 | A1 | 12/2019 | Hughes et al. | |

FOREIGN PATENT DOCUMENTS

| | | | |
|---|---|---|---|
| EP | 2902729 | A1 | 8/2015 |
| EP | 3591317 | | 1/2020 |
| JP | 2003214748 | | 7/2003 |
| JP | 2013152040 | | 8/2013 |

OTHER PUBLICATIONS

Chinese Office Action for corresponding Application No. 202180094823.3, issued Mar. 27, 2026.

* cited by examiner

REFRIGERATOR WITH A VARIABLE SPEED COMPRESSOR AND A METHOD FOR CONTROLLING THE COMPRESSOR SPEED

This invention is related to the field of refrigeration systems, more specifically to domestic refrigerators. Such systems normally comprise a compartment and a cooling system including an evaporator, a condenser and a compressor. For better controlling the refrigerant flow, the compressor might be a variable speed compressor, which often requires a control system, operating to control the compressor speed.

The need for preserving foodstuff is long known to mankind, considering the large variety of known methods available today. One of these methods would be the ice box, a relatively primitive type of refrigerator, with the purpose of lowering the temperature so as to delay the decomposition process of food. The refrigerator was introduced in the early 19th century consisting of a machine that would use a heat pump to transfer heat from the inside of the compartment to the external environment.

Modern household refrigerators now include a considerable variety of sizes and shapes, such as French Doors, built-in type, side-by-side, with top or bottom freezer, among other varieties. Not only that, but modern refrigerators also present different possible features to adjust temperatures, store different types of foodstuff, auto defrosting settings and many others to make the operation more comfortable for the user.

As the need for new, more sustainable and healthier features increase, the technologies used in such appliances also get more complex. For the last decades, many different technologies have been implemented on domestic refrigerators, and control algorithms are constantly evolving to solve the continuously presented challenges, improving the ways that food can be preserved.

As features get more complex, so does the need for efficiently controlling such features. Moreover, the user can set several inputs on modern refrigerators, specifically focused on controlling the environment inside the appliance such as temperature settings.

Usually, refrigerators are provided with a compartment to accommodate foodstuff, but it is also common to include a second compartment, or even a plurality of compartments with different environment controls. Such compartments frequently require different temperature targets for storing different types of foods (e.g. dairy, eggs, meat, fresh vegetables), so each compartment will naturally need a different cooling load from the cooling system.

For domestic refrigerators, it is a known problem to efficiently control the refrigerant flow throughout the evaporator or evaporators and thereby the control of temperatures in a compartment or compartments to be refrigerated. The need to control said flow is usually related to the different temperature settings set for each compartment in the refrigerator. Naturally, such different temperature settings require different cooling loads for each compartment.

In a particular situation, the compartments comprise two compartments in which a first compartment has a lower temperature in respect to a second compartment. Therefore, the refrigeration system includes the first colder compartment, usually called the freezer compartment, in connection with the second warmer compartment, usually called the fresh food compartment. Under these circumstances, the compressor operation is often regulated through a temperature sensor located in the fresh food compartment. If the temperature sensor determines that there is a need for cooling the fresh food compartment, i.e. if the temperature inside the compartment is too high and might compromise the self-life of refrigerated goods, then the sensor will send a signal to activate the compressor, initiating the cooling process throughout both compartments, regardless whether the freezer compartment also needs cooling.

In some circumstances, the refrigerator is equipped with two evaporators connected in series, a first evaporator being connected to the freezer compartment and a second evaporator being connected to the fresh food compartment. In this particular case, the refrigerant flow path can follow the direction from the first compartment to the second and vice-versa. The flow sequence from the fresh food compartment to the freezer compartment usually requires a valve and a second capillary, as well as a more elaborated control method. In the case of a refrigerant flow path from the freezer compartment to the fresh food compartment the rich refrigerant is initially delivered in the freezer, evaporating and absorbing heat from the freezer compartment. The quantity of refrigerant that evaporates is equivalent to the heat transfer from the freezer compartment which is proportional to the temperature difference between the refrigerant and the compartment air or cooling load.

In the scenario that the refrigerant flow path is from the freezer to the fresh food compartment, once the refrigerant finishes circulating on the first evaporator, the remaining liquid overflows to the second evaporator, where it will finish evaporating and cooling down the refrigerator.

Hence one method to take control over the distribution of cooling load between the freezer and fresh food compartment is to promote an increase in heat transfer from the freezer compartment that would reduce the available refrigerant overflow to the fresh food compartment, consequently reducing cooling in the second compartment (fresh food) and increasing cooling in the first compartment (freezer).

One of the possible ways to manipulate the cooling availability is to have a variable speed compressor in which parameters such as switch control, temperature settings and throughput affect the different speeds for the compressor operation. In the situation where the refrigerant flow path is from the freezer to the fresh food compartment, an increase of the compressor speed consequently increases the heat transfer to the freezer compartment. As the available refrigerant is reduced on the fresh food compartment, the cooling load balance between compartments can be better regulated.

In order to accomplish an efficient control of the cooling system, many known refrigerators have complex control systems, as parameters must be precisely coordinated so that the cooling loads are sufficiently well balanced.

One known solution to this problem is disclosed in WO 2012/150196 A1, presenting a solution in which the targeted throughput of the compressor is controlled, aiming for a higher throughput. However, the solution presented is dependent of common variables actively controlled by the sensors in the compartments, external sensors or duty cycles, which sets a reasonably complex control system.

An improved control method of the compressor is, thus, a constant need for improved operation of such refrigerators.

The invention aims to solve, or at least reduce, the aforementioned problems. A refrigerator achieving this is disclosed in independent claim 1 and improvements of the invention are disclosed in dependant claims 2-10.

According to the invention, a refrigerator comprising a compartment for storing foodstuff is provided. The refrigerator further comprises a cooling system that includes an evaporator, a condenser and a variable speed compressor, and the cooling system is adapted to go through a refrigeration cycle at certain intervals. The refrigeration cycle is hereby referred to as the time period in which the variable speed compressor is active and operating, which implicates that the refrigeration cycle stops once the variable speed compressor is switched off. The time period can be influenced by many parameters and the intervals can be based on time, temperature or any other relevant factors. A control system is provided for controlling the variable speed compressor during the refrigeration cycle and said control system operates in relation to a minimum speed and a required speed. The control system sets a compressor speed, which is understood as the actual compressor speed, according to a comparison between the minimum speed and the required speed. If the minimum speed is lower than the required speed, then the control system will set the compressor speed to the required speed; Otherwise, the control system will set the compressor speed to the minimum speed. Consequently, the control system constantly sets the compressor speed to the highest value of the required speed and the minimum speed.

The refrigerator with such control system is especially advantageous when a minimum speed is set, as it drives the compressor to work at a more efficient speed. In that way, there is a better control of refrigerant flow within the system, reasonably improving energy efficiency. Moreover, by calculating a minimum speed in the way disclosed herein, it is not necessary to provide other external inputs to control the compressor speed, which simplifies this method, providing a good balance of the cooling system without the inherent costs of complexity.

According to some embodiments, the control system might operate in a step-by-step manner.

According to some embodiments, the control system is configured to calculate the minimum compressor speed based on elapsed time from the start of the refrigeration cycle and could further be based on temperature settings. The temperature settings can also be referred to as setpoints, usually set by user input, selecting the preferred temperature for the refrigeration compartments manually, commonly through a display or user interface. The temperature settings could also be a relative position, such as Min/Med/Max or High/Low or a numerical scale. The temperature control inside the compartments might follow common techniques such as PID, Fuzzy or MPC controllers, providing at least one temperature sensor arranged in the compartment with the highest set temperature, but it is also not limited to it. It is advantageous to calculate the minimum compressor speed based on temperature settings as the compressor speed is not actively controlled by cabinet sensors or other inputs besides the temperature settings, which provides the possibility of a better balance of the systems with simpler control.

According to some embodiments, the control system is configured to calculate the required speed through common methods such as the PI control, based specifically on the difference between measured temperature and set temperature, but not limited to it. The required speed might also be determined in other arrangements within the compressor controller without a temperature feedback or any other link to the main control except a switch control for the variable speed compressor.

According to some embodiments, the control system with a switch control is provided. The switch control is configured to start the variable speed compressor at the onset of the refrigeration cycle and stop the variable speed compressor at the end of the cycle. It is advantageous to control the compressor operation routine to increase energy saving for the refrigeration system. The provision of a switch enables to control the compressor in a way that it will remain switched off as long as possible, enabling a more energy efficient set-up.

According to some embodiments, the refrigerator comprises a second compartment. This configuration is especially important in case the compartments are at different temperatures. The presence of two compartments at two different temperatures in a refrigerator indicates that it is usually difficult to control the cooling loads between those compartments. In other words, it is especially hard to keep the desired temperatures in the compartments, requiring an efficient control. The control system described herein is specially adapted to control the compressor speed in a balanced and, thus, more efficient manner. If the compressor speed is well controlled, then it is easier to keep the desired temperatures set by the user. The control system ultimately provides a better refrigerant flow control, according to the pre-determined necessary cooling loads for each compartment.

According to some embodiments, the compartment and the second compartment are connected through a channel, and the cooling system comprises a fan to generate forced air circulation between said compartments. The fan is often arranged in the first compartment, allowing cooled air to be better redistributed using forced air circulation. In this way, the set temperature in the compartments determined by the temperature settings might be reached in a faster and easier way.

According to some embodiments, the cooling system comprises a second evaporator connected in series with the evaporator. One possible and often common configuration provided is that each evaporator is connected to one compartment of the refrigerator. During the refrigeration cycle, the refrigerant must go through the first evaporator on the circuit and then through the second evaporator on the circuit. Such serial configuration creates a direct dependency of the evaporators, requiring an efficient control between the cooling loads demanded by each compartment. If the compressor speed is well controlled by the control system, then the refrigerant flow is more efficiently managed between the evaporators, and it is easier to keep the desired temperatures set by the user in the compartments. The control system ultimately provides a better refrigerant flow control through the evaporators, according to the pre-determined necessary cooling loads for each compartment.

According to some embodiments, the evaporator is connected to the compartment, which is a freezer compartment, and the second evaporator is connected to the second compartment, which is a fresh food compartment, and the flow path of a refrigerant fluid is from the evaporator to the second evaporator. This embodiment is especially advantageous for the invention, as it allows the control system to be more efficient by increasing the compressor speed and, consequently, promoting an increase in heat transfer from the compartment. Such increase corresponds to a reduction of the available refrigerant overflow to the second compartment, consequently reducing the cooling capacity availability in the second compartment and increasing the availability in the first compartment.

A method for the solution discussed herein is disclosed in accordance with the invention in independent method claim 11 and improvements of the invention are disclosed in dependant method claims 12-15.

The method of controlling a variable speed compressor through a control system, the variable speed compressor being in a cooling system of a refrigerator with a compartment, the cooling system being adapted to go through a refrigeration cycle at certain intervals, comprising the steps of:

(a) starting the refrigeration cycle;
(b) calculating a minimum speed;
(c) calculating a required speed;
(d) comparing the minimum speed and the required speed;
(e) setting the compressor speed to the highest speed of the minimum speed and the required speed;
(f) evaluating if the end of the refrigeration cycle is reached, if not, calculating steps (a) to (e) until the end of the refrigeration cycle; and
(g) stopping the refrigeration cycle.

The method can be visualized by plotting a speed graph during the refrigeration cycle, which ends based on whether the temperature in the compartment reached the desired target according to temperature settings, or other relevant parameters such as the maximum time limit for the variable speed compressor to be active. Moreover, the refrigeration cycle can fluctuate within a great range of intervals, as it can last from minutes up to hours, and there are no pre-set time limits, once the refrigeration cycle varies according to many factors.

Possibly, step (b) is accomplished by considering an elapsed time from the start of the refrigeration cycle and further accomplished by considering temperature settings. It is possible that step (c) is accomplished by considering temperature parameters, specifically the difference between a measured temperature and a set temperature. It is understood that the measured temperature is the reading response from a temperature sensor in a compartment of the refrigerator, while the set temperature is a target temperature introduced by temperature settings.

Further features and advantages of the invention will become clear from the following description of exemplary embodiments with reference to the attached figures.

The invention will, in the following, be described in more detailed referring to the figures wherein.

Figure 1:
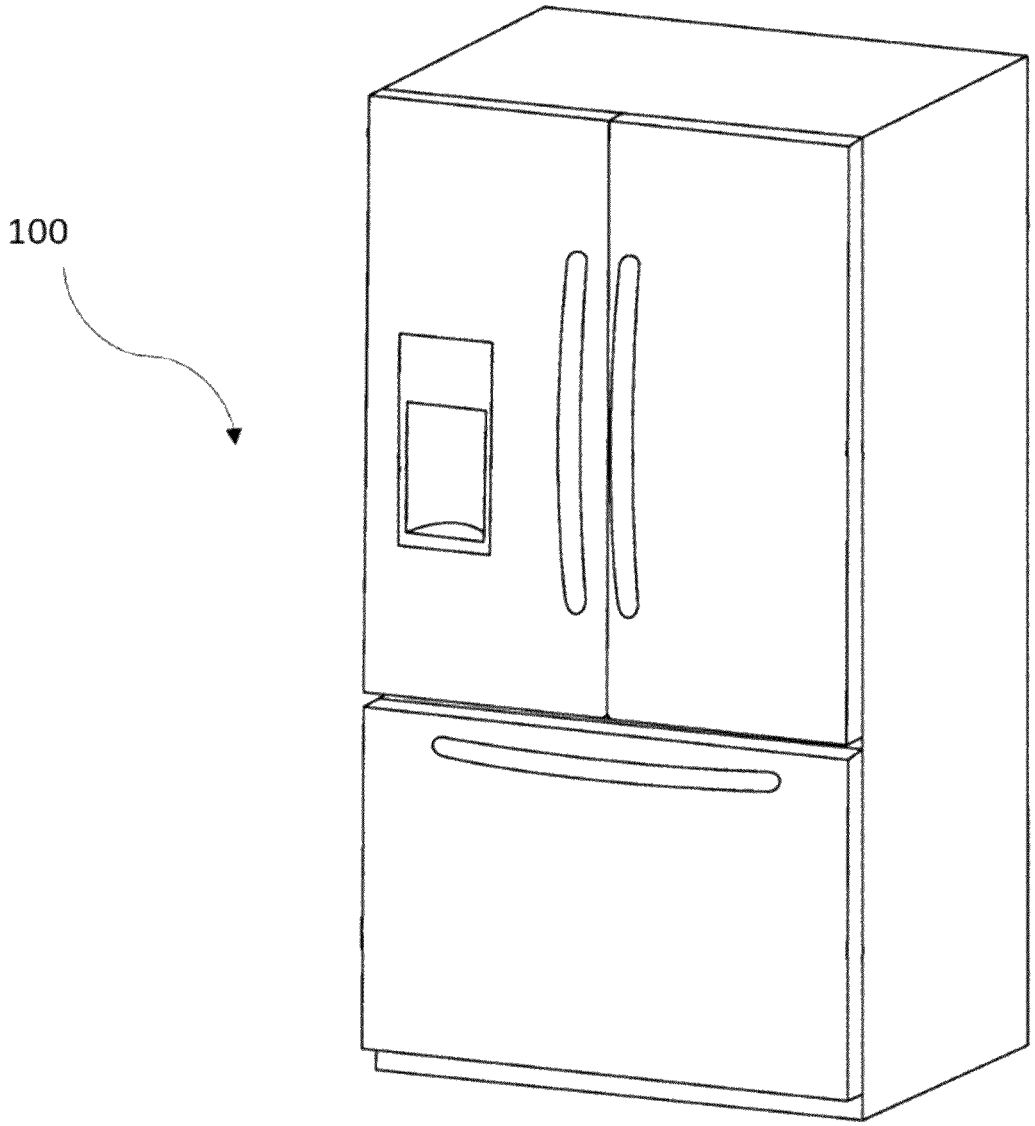
FIG. 1 shows an external view of a refrigerator.

Considering the field of refrigeration systems, one of the machines commonly found in a household are domestic refrigerators. Such systems comprise a compartment, and a cooling system including an evaporator, a condenser and a compressor. As showed in FIG. 1, an external view of a refrigerator is indicated generally at 100. For the purpose of this invention, a modern household refrigerator is provided. FIG. 1 merely represents one possible view of such refrigerator 100. Naturally, it can include a variety of sizes and shapes, including French Doors, built-in types, side-by-side, with top or bottom freezer, among other varieties. Not only that, but it can also present different possible features to adjust temperatures, including special compartments, handles, water and/or ice dispenser, auto defrosting settings and many other features not specifically mentioned herein.

Figure 2:
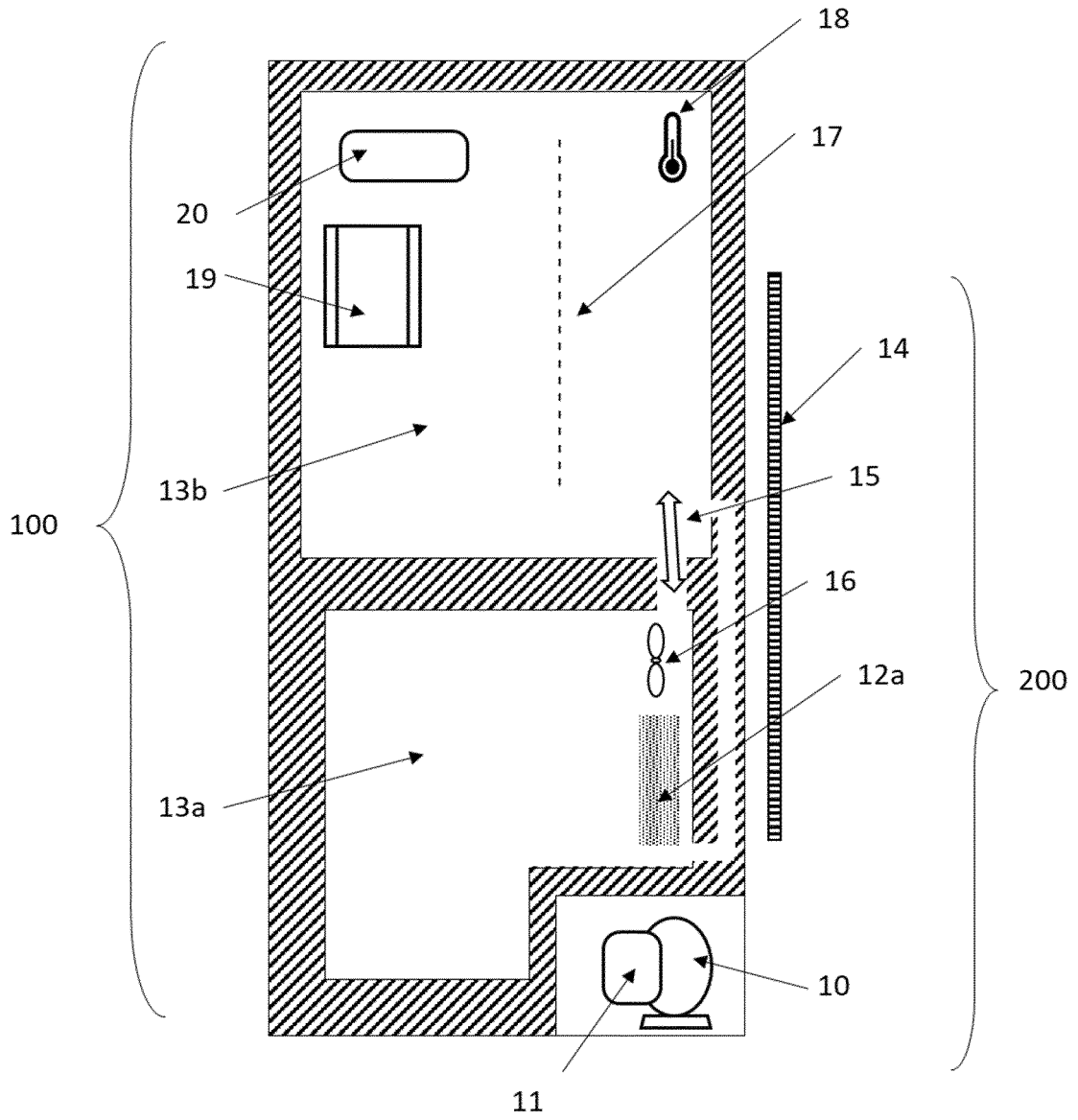
FIG. 2 shows a principal sectional side view of a refrigerator embodiment.

A principal sectional side view, with a layout of the interior components, of the refrigerator 100 is shown in FIG. 2 to demonstrate the components, considering one embodiment. Such refrigerator 100 includes a compartment 13*a* and a cooling system 200 comprising an evaporator 12*a*, a condenser 14, a variable speed compressor 10 and a capillary tube 01, not shown. Naturally, the cooling system 200 might comprise many different known arrangements. The refrigerator 100 can also include a second compartment 13*b*, and possibly more compartments either connected or with a separation, represented by the dotted line 17.

The cooling system 200 in FIG. 2 is adapted to go through a refrigeration cycle at certain intervals. Such refrigeration cycle is, in the present application, referred to as the time period in which the variable speed compressor 10 is active and operating. The time period can be influenced by many parameters and the intervals can be based on time, temperature or any other relevant factors. It is assumed that the cooling can continue even if the variable speed compressor 10 is stopped due to residual refrigerant flow in the cooling system 200.

The refrigerator in FIG. 2 includes a control system 11 for controlling the variable speed compressor 10 during the refrigeration cycle. Other arrangements and features of the refrigerator are known and might be assumed to be included in the presented embodiment.

The second compartment 13*b* includes a temperature sensor 18, and the compartment 13*a* includes a fan 16 and a channel 15, configured to generate forced air circulation between said compartments. It is possible that the compartments have different temperature settings selected through user input, considering that in this invention the compartment 13*a* can be referred to as a freezer compartment, and it is set to be in a colder temperature than the second compartment 13*b*. Thus, the second compartment 13*b* is the warmer compartment, and can be referred to as a fresh food compartment, in relation to the compartment 13*a*. It is also possible to select special operation modes through a display 19, which can be any kind of digital or mechanical user interface, including connected devices (internet of things).

It is also provided in FIG. 2 a main control 20 in the refrigerator 100 embodiment, which operates the mainframe of the cooling system 200.

Figure 3:
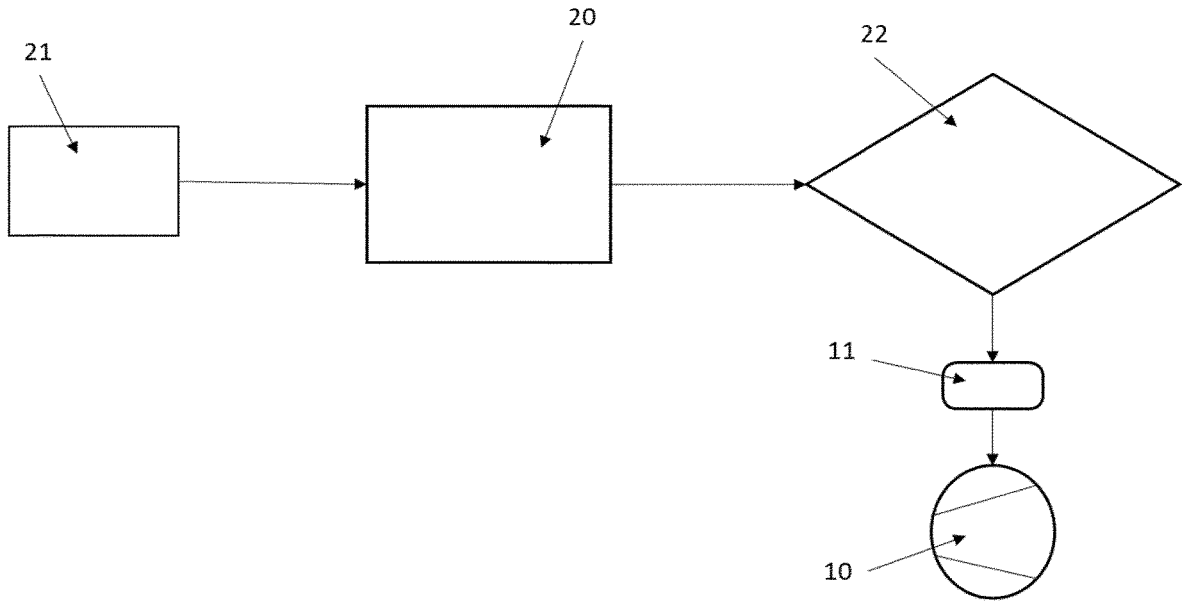
FIG. 3 shows an embodiment of a main control.

FIG. 3 shows an embodiment of the main control 20, which is the refrigerator 100 central control. The main control 20 controls the refrigerator 100 routine and operation. The main control 20 refers to the whole system of the refrigerator 100, configured to control all other necessary arrangements and parts of the refrigerator 100 not necessarily related to the control of the variable speed compressor 10. Such main control 20 operates through several methods including electrical control or mechanical thermostat control, both possible on the embodiment described herein.

One possible main control 20 operation is showed in FIG. 3. As the main control 20 manages several signals to actuators of known and common use, it requires relevant inputs 21, which can comprise in the simplest condition the temperature settings provided through user input, but also other parameters such as compartments temperatures, provided by the temperature sensor 18, and special operation modes. An important possible output of the main control 20 is a required speed 22, which will be incorporated as an input into the control system 11 operation, ultimately contributing to control the speed of the variable speed compressor 10.

Figure 4:
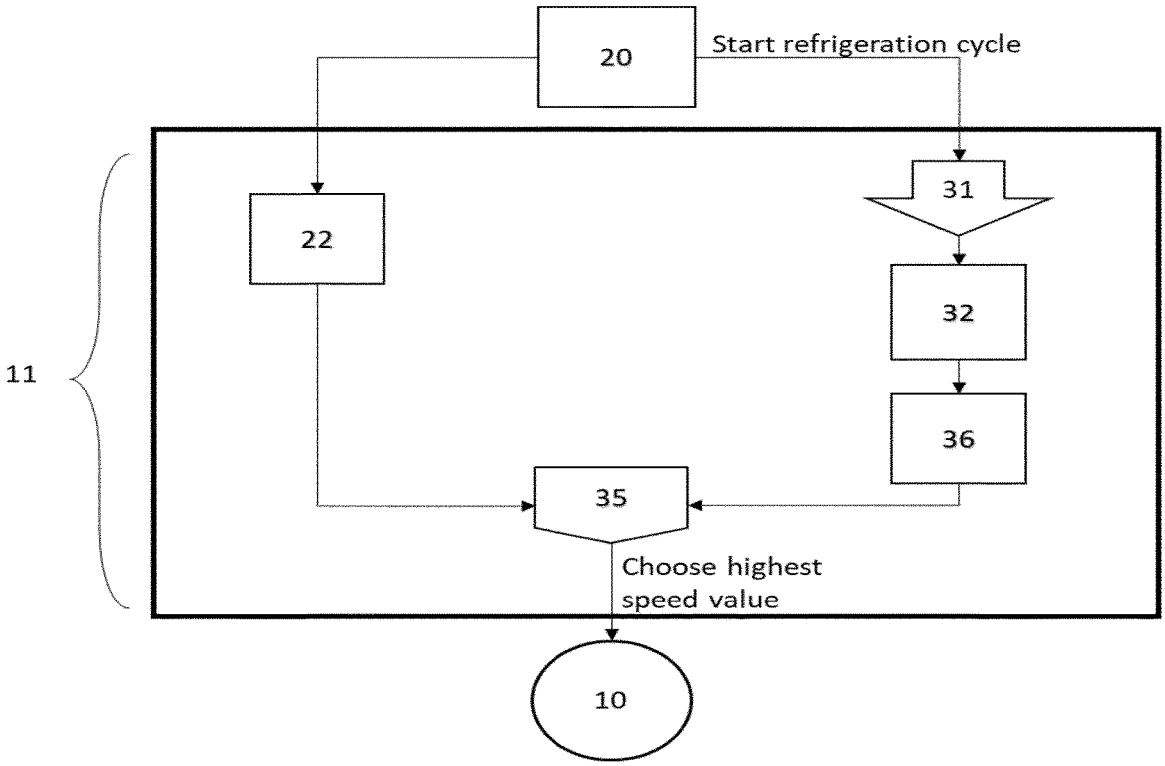
FIG. 4 shows an overview of a control system.

The control system 11 operation is disclosed in FIG. 4. The object of such control system 11 is to ensure that the correct speed value is set on the compressor, in relation to two main variables: the minimum speed 36 and the required speed 22. The control system 11 operates in a step-by-step manner, following several steps to ensure the compressor is operated correctly. One of the external sources of inputs can be the main control 20, represented outside of the control system 11. As stated before, the main control 20 provides the calculation for the required speed 22, but it also signals to a switch control 31, located in the control system 11, that it is necessary to switch on the variable speed compressor 10, with the start of the refrigeration cycle. Furthermore, the main control 20 is responsible to provide other possible inputs to the control system 11, such as temperature settings.

As shown in FIG. 4, once the refrigeration cycle is started, the switch control 31 starts the compressor operation and a time counter 32 is activated. The time counter 32, which allows a minimum speed 36 to be calculated, and such minimum speed 36 may also be further calculated based on temperature settings. The calculated values of the minimum speed 36 and the required speed 22 are fed to a speed function 35, which is configured to compare both values and set a compressor speed to the highest of the minimum speed 36 and the required speed 22. Therefore, the speed function chooses the highest value to be set as the actual speed of the variable speed compressor 10 throughout the refrigeration cycle.

Figure 5:
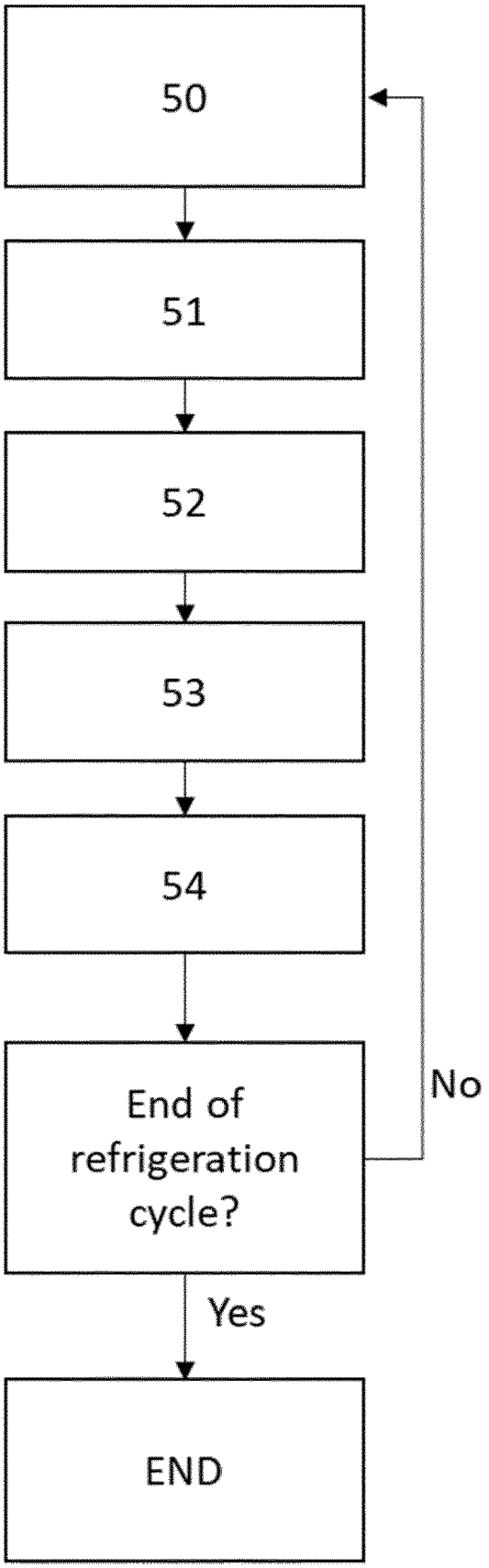
FIG. 5 shows a method flow for the control system.

Considering the control system 11, it can be described as an algorithm following the steps showed in FIG. 5, within the speed function 35. The following steps are provided in FIG. 5:

(a) starting the refrigeration cycle, represented by box 50;
(b) calculating a minimum speed 36, represented by box 51;
(c) calculating a required speed 22, represented by box 52;
(d) comparing the minimum speed and the required speed, represented by box 53;
(e) setting the compressor speed to the highest speed of the minimum speed 36 and the required speed 22, represented by box 54.

Then, the system evaluates if the end of the refrigeration cycle is reached, which is based on whether the temperatures in the compartment 13*a* and the compartment 13*b* are within the desired target according to temperature settings, so the compressor must be stopped, ending the refrigeration cycle. If such scenario has not yet been reached, the calculation of steps (a) to (e) shown in FIG. 5 will continue, until the refrigeration cycle ends. Moreover, the time period in which the variable speed compressor 10 remains active, i.e. the refrigeration cycle, can present a reasonable range of time variation. Therefore, there is no pre-set time limit for the refrigeration cycle, as the duration can be influenced by many parameters and the intervals can be based on maximum active time for the compressor, temperature parameters or any other relevant factors.

Figure 6:
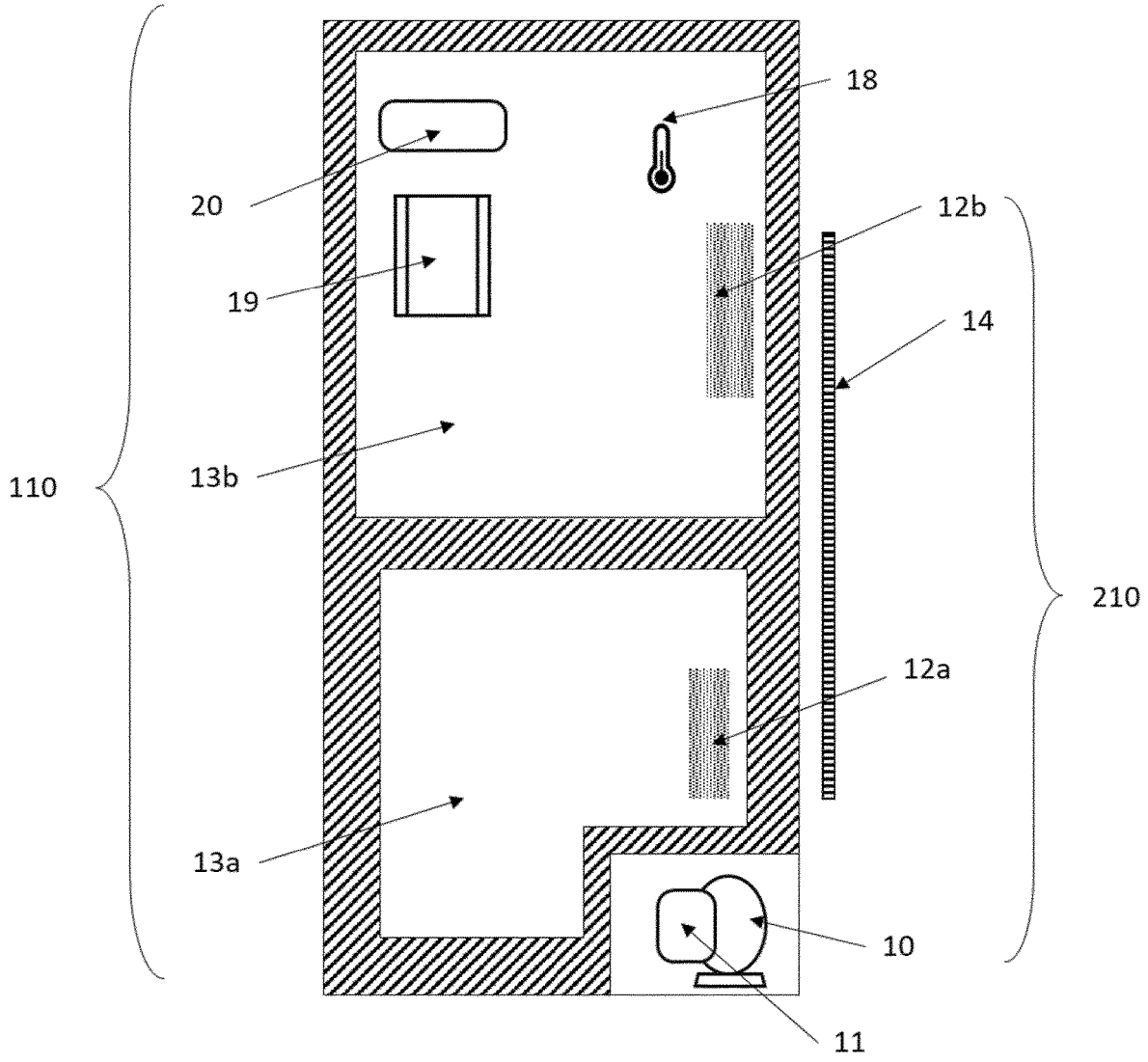
FIG. 6 shows a principal sectional side view of the refrigerator in one second embodiment.

A second embodiment of a refrigerator 110 is shown in FIG. 6. It shows the preferred embodiment comprising two evaporators, wherein the evaporator 12*a* is connected in series to a second evaporator 12*b*. Naturally, the evaporator 12*a* is connected to the compartment 13*a* and the evaporator 12*b* is connected to the compartment 12*b*. However, the same principles described for the refrigerator 100 can be applied. This embodiment thus encompasses another embodiment of the cooling system 210, which is slightly different compared to the cooling system 200. The other components shown in FIG. 6 can be the same and therefore retain the same numeral numbers as the first embodiment of the refrigerator 100.

Figure 7:
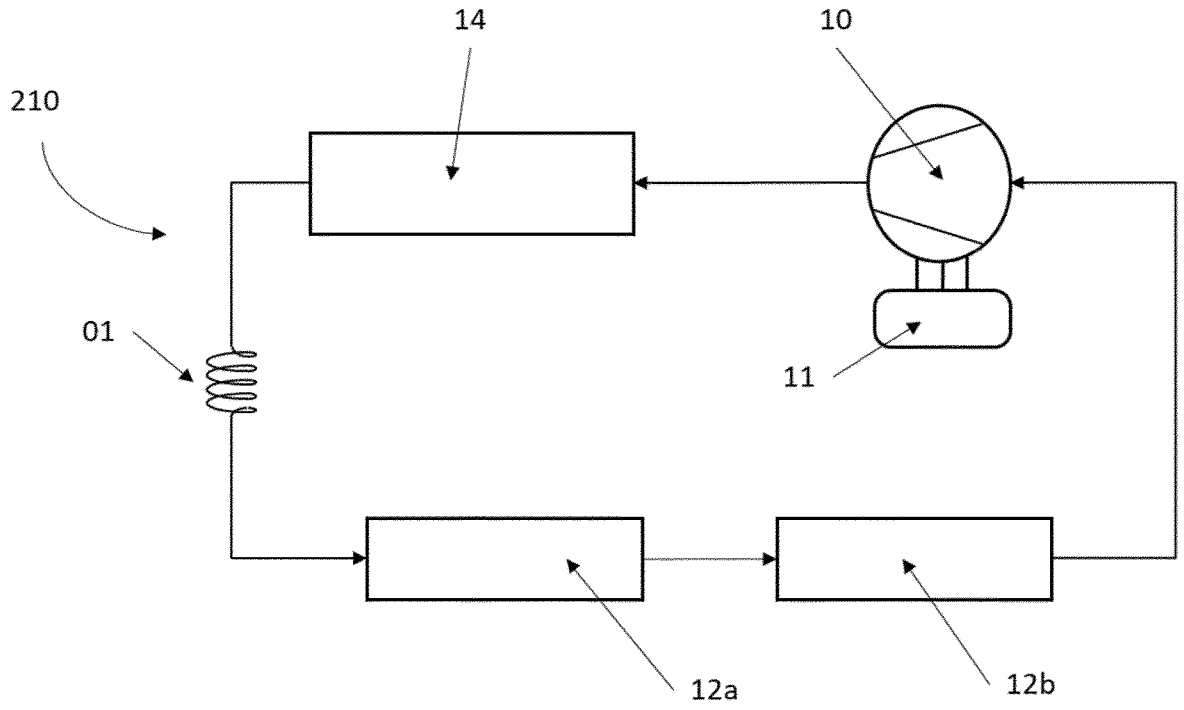
FIG. 7 shows a schematic of a cooling system.

FIG. 7 shows the cooling system 210, with a circuit in which the refrigerant can flow through, comprising the condenser 14, a capillary tube 01, the evaporator 12*a* connected in series with the second evaporator 12*b* and the variable speed compressor 10, which is connected to the control system 11. In this embodiment the flow path follows the direction from the evaporator 12*a* to the second evaporator 12*b*, however it could be the other direction, as well as other possible arrangements. The flow path following the direction showed in FIG. 7 allows the control system 11 to be more efficient by increasing the compressor speed and, consequently, promoting an increase in heat transfer from the compartment 13*a*. Such increase corresponds to a reduction of the available refrigerant overflow to the second compartment 13*b*, consequently reducing the cooling capacity availability in the second compartment 13*b* and increasing the availability in the first compartment 13*a*.

All described features compose an exemplary conventional cooling system 210 with a control system 11, therefore it is possible that other configurations with standard components can be used.

Figure 8:
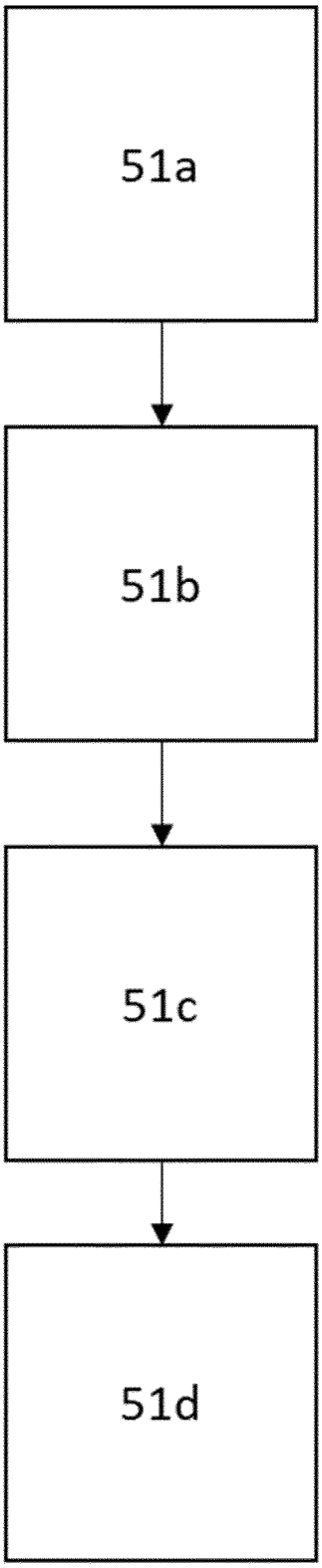
FIG. 8 shows a method flow for a minimum speed.

During the refrigeration cycle, regardless of which embodiment of the refrigerator 100, 110 that is considered, several scenarios are possible for the variable speed compressor 10 operation. The control system 11 provided, calculates the minimum speed 36 in relation to at least the elapsed time from the start of the refrigeration cycle and further related to temperature settings. The minimum speed 36 can be active in all operation conditions, not limited to using only said minimum speed 36, as the refrigerator 100, 110 operation may include other operation modes that might increase the compressor speed if necessary. The minimum speed 36 profile is not necessarily controlled actively by compartment sensors or other inputs besides the elapsed time and user input of temperature settings, which provides the possibility of a better balance of this system, with simple temperature control. Considering step (b) of calculating the minimum speed 36, FIG. 8 shows the method flow for said calculation, comprising the steps of:

(b1) Set working temperature according to temperature settings, represented by box 51*a;*
(b2) Start elapsed time counter, represented by box 51*b;*
(b3) Set a TIME×SPEED matrix, represented by box 51*c;*
(b4) Obtain the result of the minimum speed 36 for the control system 11, represented by box 51*d.*

One possible way of calculating the minimum speed 36 is based on a linear interpolation between values listed on a matrix with time by speed lines, as described above. Hence, from the refrigeration cycle start until a determined time, the speed will linearly move from one speed value to another. The changes of the matrix set by step (b3) are intended to change the temperature difference between the compartment 13*a* and the second compartment 13*b*. Naturally, the second compartment 13*b*, in which the temperature sensor 18 is assembled, possibly has its temperature well defined by such sensor. Thus, in the scenario when the temperature sensor 18 measures the refrigerator 100, 110 temperature, the compartment 13*a* is indirectly controlled by changing the compressor speed. The ultimate outcome is thus to provide control to the compartment 13*a* where there was no active control means.

Figure 10:
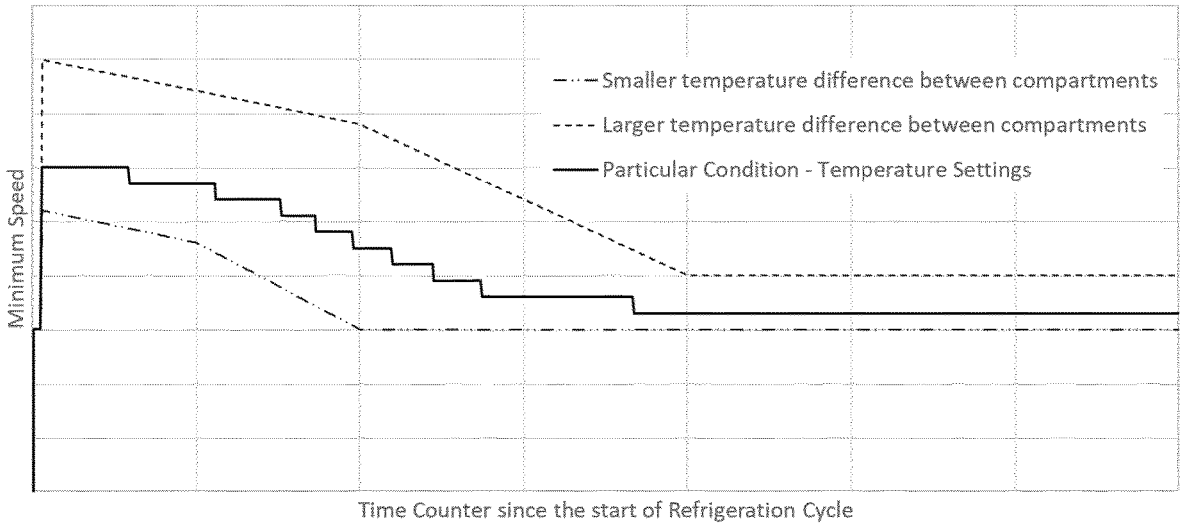
FIG. 10 shows a graph of one example of the minimum speed graph plot.

One example of the minimum speed graph plot is represented in FIG. 10. And in this case two compartments are present: the compartment 13*a*, designated as a freezer compartment or the lowest temperature compartment, and the second compartment 13*b*, designated as a fresh food compartment or the highest temperature compartment. During the refrigeration cycle, regardless of which embodiment of the refrigerator 100, 110 that is considered, the plot in FIG. 10 shows three outcomes for the minimum speed 36:

A middle solid line plot as the 'Particular Condition—Temperature Settings' shows one specific input of temperature settings;

An upper dotted line plot 'Larger temperature difference between compartments', showing a condition in which the compartment 13*a* is set to be in a colder temperature in relation to the 'Particular Condition—Temperature Settings' plot, as well as the second compartment 13*b* is set to be in a warmer temperature in relation to the middle solid line plot. Thus, the difference of temperature between compartments is larger than the one considered in the middle solid line plot;

A lower dotted line plot 'Smaller temperature difference between compartments', showing a condition in which the compartment 13*a* is set to be in a warmer temperature in relation to the 'Particular Condition—Temperature Settings' plot, as well as the second compartment 13*b* is set to be in a colder temperature in relation to the middle solid line plot. Thus, the difference of temperature between compartments is smaller than the one considered in the middle solid line plot.

The graph in FIG. 10 shows that, for any condition on Temperature Settings, a normal operation would be that as soon as the refrigeration cycle is started, the minimum speed 36 is immediately raised and then lowered to a constant speed after a pre-determined time and configured to remain constant until the refrigeration cycle is stopped. However, other speed graphs profiles could apply, as an example, it could be possible to have an additional speed raise towards the end of cycle. The initial immediate raised speed showed in FIG. 10 is advantageous as usually the variable speed compressor 10 requirement to be turned-on is related to the compartment 13*b*, which is the warmest compartment, so it is advantageous to have a high cooling capacity initially available to ensure the temperatures are recovered as fast as possible. Moreover, lowering the minimum speed 36 to a constant lower level until the variable speed compressor 10 is switched off is advantageous as it allows energy savings. Considering the required speed 22 calculation, it is possible to apply several common methods to obtain such speed. The preferred method is the PI control, based specifically on the difference between measured temperature and set temperature, but not limited to it. Considering one possibility showed in FIG. 9, it is preferably calculated based on regular PI control, with the temperature error based on a set temperature and a measured temperature. The calculation will follow step (c) of, showed in FIG. 9, comprising the steps of:

(c1) Start the calculation, represented by box 52*a;*

(c2) Assess set temperature through temperature setting, represented by box 52*b;*

(c3) Assess measured temperature through a temperature sensor, represented by box 52*c;*

(c4) Calculate the temperature error, represented by box 52*d;*

(c5) Obtain constant values according to PI method, represented by box 52*e;*

(c6) Calculate the integral function, represented by box 52*f;*

(c7) Obtain the result of the required speed 22 for the control system 11, represented by box 52*g*.

Figure 9:
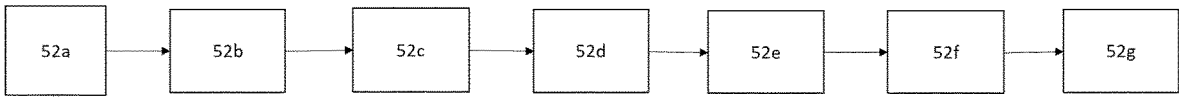
FIG. 9 shows a method flow for a required speed.

In FIG. 9, the set temperature can be directly input by the user control of an exact desired temperature, or also possibly through the temperature settings interpreted by the main control 20 from the user input. The measured temperature is the actual temperature measured by the temperature sensor 18 inside the compartment. The required speed 22 function is capped within the speed zero and a maximum compressor speed. The temperature error is then incorporated into an integral equation with constants and variable inputs, as it is known for the PI control. It is common to see implementations where the PI parameters are changed according to the temperature error or any other external parameter, such as compressor duty cycle and external temperature.

The required speed 22 might also be determined in other arrangements within the control system 11 without a temperature feedback or any other link to the main control 20 except the switch control 31. This possible calculation for the required speed is based on a duty cycle, which is a function related to elapsed times both from the start and the stop of the refrigeration cycle, meaning an elapsed time from the time the compressor is switched on and an elapsed time from the time the compressor is switched off. The function of the duty cycle is plotted in relation to a matrix related to speed. Naturally, the minimum speed 36 function described in FIG. 8 is still valid for all possibilities of obtaining the required speed 22.

Figure 11:
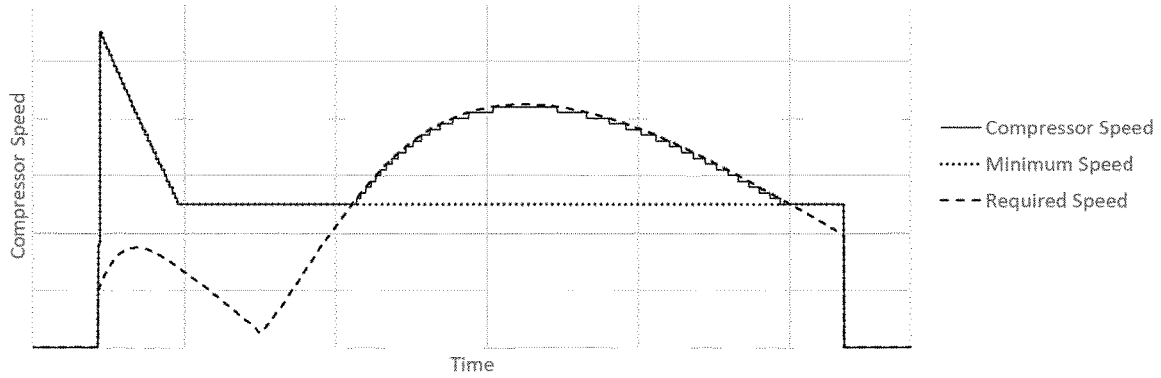
FIG. 11 shows a graph of one example of the speed graph plot in a typical operation.

FIG. 11 shows an example of a visualization of a speed graph, indicating how the compressor speed (solid line), adapts to the highest of the minimum speed 36 and the required speed 22. The speed graph always considers that within the minimum speed 36 calculation, a possible profile is selected as the algorithm analyses a good compromise among energy consumption, temperature stability, cooling and freezing capacity as the refrigerator 100, 110 might have a quite limited number of sensors. Hence, one benefit is the compressor speed is neither a function of room temperature nor internal cabinet temperature.

Such features can also occur in combinations other than those specifically disclosed here. The fact that several characteristics are mentioned in the same sentence or in a different type of textual context does not therefore justify the conclusion that they can only occur in the specifically disclosed combination, instead, it can generally be assumed that several of these characteristics can also be omitted or modified, provided that the functionality of the invention is not modified.

The invention claimed is:

1. A refrigerator (100; 110) comprising a compartment (13*a*) for storing foodstuff, a cooling system (200; 210) comprising an evaporator (12*a*); a condenser (14) and a variable speed compressor (10), the cooling system (200; 210) being adapted to go through a refrigeration cycle at certain intervals;

a control system (11) is configured to control the variable speed compressor (10) during the refrigeration cycle based on values of a minimum speed (36) and a required speed (22), whereby when the minimum speed (36) is lower than the required speed (22) then the control system (11) is configured to set the compressor speed (35) to a speed value equal to the required speed (22); and when the minimum speed (36) is higher than the required speed (22) then the control system (11) is configured to set the compressor speed (35) to a speed value equal to the minimum speed (36); and wherein the control system (11) is configured to set an actual speed of the variable speed compressor (10) to the speed value.

2. The refrigerator (100; 110) according to claim 1, wherein the control system (11) is configured to control the variable speed compressor (10) in a step-by-step manner.

3. The refrigerator (100; 110) according to claim 1, wherein the control system (11) is configured to calculate the minimum speed (36) in relation to an elapsed time from the start of the refrigeration cycle.

4. The refrigerator (100; 110) according to claim 3, wherein the control system (11) is configured to further calculate the minimum speed (36) based on temperature settings.

5. The refrigerator (100; 110) according to claim 1, wherein the control system (11) is configured to calculate the required speed (22) based on temperature parameters, comprising the difference between a measured temperature and a set temperature.

6. The refrigerator (100; 110) in accordance with claim 1, wherein the control system (11) comprises a switch control (31) configured to start the variable speed compressor (10) at the onset of the refrigeration cycle and stop the variable speed compressor (10) at the end of the refrigeration cycle.

7. The refrigerator (100; 110) according to claim 1, wherein the refrigerator comprises a second compartment (13*b*).

8. The refrigerator (100) according to claim 7, wherein the compartment (13*a*) and the second compartment (13*b*) are connected through a channel (15), and the cooling system (200) comprises a fan (16) to generate forced air circulation between the compartment (13*a*) and the second compartment (13*b*).

9. The refrigerator (110) according to claim 7, wherein the cooling system (210) comprises a second evaporator (12*b*) in series with the evaporator (12*a*).

10. The refrigerator (110) according to claim 9, wherein the evaporator (12*a*) is connected to the compartment (13*a*), which is a freezer compartment, and the second evaporator (12*b*) is connected to the second compartment (13*b*), which is a fresh food compartment, and the flow path of a refrigerant fluid is from the evaporator (12*a*) to the second evaporator (12*b*).

11. The refrigerator of claim 1, wherein the control system comprises a memory, the memory being configured to store a minimum speed graph plot for setting the minimum speed.

12. A method of controlling a variable speed compressor (10) in a cooling system (200; 210) of a refrigerator (100; 110), the cooling system (200; 210) going through a refrigeration cycle at certain intervals, comprising:

(a) starting the refrigeration cycle;

(b) calculating a minimum speed (36);

(c) calculating a required speed (22);

(d) comparing the minimum speed (36) and the required speed (22);

(e) setting the compressor speed to the highest speed of the minimum speed (36) and the required speed (22);

(f) evaluating when the end of the refrigeration cycle is reached, and performing steps (a) to (e) until the end of the refrigeration cycle is reached; and (g) stopping the refrigeration cycle when the end of the refrigeration cycle is reached.

13. The method of claim 12, wherein a speed graph is visualized during the refrigeration cycle.

14. The method of claim 12, wherein the step (b) calculating the minimum speed (36) is made by determining an elapsed time from the start of the refrigeration cycle.

15. The method of claim 14, wherein the step (b) calculating a minimum speed (36) includes the consideration of temperature settings.

16. The method of claim 12, wherein the step (c) calculating a required speed (22) is made by determining temperature parameters, comprising the difference between a measured temperature and a set temperature.

* * * * *